United States Patent [19]

Thomasson et al.

[11] Patent Number: 4,962,774

[45] Date of Patent: Oct. 16, 1990

[54] TOBACCO RECONSTITUTION PROCESS

[75] Inventors: James S. Thomasson, Statesville; Elwood L. Williams, Jr., Lewisville; Barry L. Bryant, Clemmons; Cynthia H. Curtis, Kernersville; Thomas W. Brown, Winston-Salem, all of N.C.

[73] Assignee: R. J. Reynolds Tobacco Company, Winston-Salem, N.C.

[21] Appl. No.: 272,156

[22] Filed: Nov. 16, 1988

[51] Int. Cl.[5] ..... A24B 3/14

[52] U.S. Cl. ..... 131/309; 131/297; 131/310; 131/370

[58] Field of Search ..... 131/309, 310, 297, 298, 131/370

[56] References Cited

U.S. PATENT DOCUMENTS

| | | | |
|---|---|---|---|
| 1,016,844 | 2/1912 | Moonelis . | |
| 1,068,403 | 7/1913 | Maier . | |
| 2,128,043 | 8/1938 | Garner | 87/28 |
| 3,353,541 | 11/1967 | Hind et al. . | |
| 3,398,754 | 8/1968 | Tughan . | |
| 3,428,053 | 2/1969 | Schoenbaum et al. . | |
| 3,464,422 | 9/1969 | Light et al. . | |
| 3,540,455 | 11/1970 | Fiore et al. . | |
| 3,847,163 | 11/1974 | Molyneux | 131/143 |
| 3,847,164 | 11/1974 | Mattina et al. | 131/143 |
| 4,607,646 | 8/1986 | Lilly, Jr. et al. | 131/309 |
| 4,674,519 | 6/1987 | Keritsis et al. . | |
| 4,744,375 | 5/1988 | Denier et al. | 131/309 |

OTHER PUBLICATIONS

*Flavouring Reconstituted Tobacco,* Silberstein, vol. 1, pp. 26–29, TJI (1985).

*Tobacco Encyclopedia,* edited by Voges, pp. 389–390, TJI (1984).

*Primary Examiner*—V. Millin

[57] ABSTRACT

Reconstituted Tobacco has ammonia incorporated therein. Tobacco is extracted with water to yield an insoluble portion and an aqueous portion containing water soluble tobacco components. The aqueous portion is contacted with ammonia to yield an ammoniated extract. The extract is applied to the insoluble portion which has been formed into a sheet-like shape. The resulting tobacco composition is dried to yield a reconstituted tobacco material treated with ammonia.

10 Claims, 1 Drawing Sheet

TABACCO RECONSTITUTION PROCESS

BACKGROUND OF THE INVENTION

The present invention relates to tobacco processing, and in particular to a method for chemically modifying a tobacco extract.

Cigarettes are popular smoking articles which have a substantially cylindrical rod shaped structure and include a charge of tobacco material surrounded by a wrapper such as paper thereby forming a so-called "tobacco rod." It has become desirable to manufacture cigarettes having cylindrical filters aligned in an end-to-end relationship with the tobacco rod. Typically, filters are manufactured from fibrous materials such as cellulose acetate, and are attached to the tobacco rod using a circumscribing tipping material. See, Baker, *Prog. Ener. Combust. Sci.*, Vol. 7 pp. 135–153 (1981).

Typical cigarettes include blends of various tobaccos, such as the flue-cured, Burley, Maryland and Oriental tobaccos. Cigarette blends also can include certain amounts of processed and reconstituted tobacco materials. Reconstituted tobacco materials often are manufactured from tobacco stems, dust and scrap using paper-making processes. See, *Tobacco Encyclopedia*, edit. by Voges, pp. 389–390, TJI (1984). In certain instances, it is desirable to enhance the flavor of reconstituted tobacco materials by treating such materials with ammonia. Oftentimes, reconstituted tobacco material is treated with anhydrous ammonia or with an aqueous ammonium hydroxide solution after manufacture of the reconstituted material is complete.

It would be desirable to provide an efficient and effective process for providing a reconstituted tobacco material which has been treated with ammonia.

SUMMARY OF THE INVENTION

The present invention relates a process for providing a reconstituted tobacco material. The process involves extracting components from tobacco using a solvent having an aqueous character. As such, an aqueous tobacco extract and a water insoluble tobacco portion are provided. At least a portion of the aqueous extract is separated from the insoluble portion. The insoluble portion then is formed into a desired shape (eg., a sheet-like shape); and the aqueous tobacco extract is contacted with ammonia. The ammonia can be in an anhydrous form or as ammonium hydroxide (e.g., in an aqueous solution), and is contacted with the aqueous extract so as to ammoniate the extract. The aqueous tobacco extract then is applied to the formed insoluble portion; and the resulting tobacco composition is dried to the desired moisture level, thereby providing a reconstituted tobacco material which has been treated with ammonia.

The resulting reconstituted tobacco material can be employed using techniques known in the art. For example, the reconstituted tobacco material can be provided in a sheet-like form having a thickness approximating that of tobacco leaf lamina; and the material can be blended with other tobacco materials, cut to the desired size, and employed as smokable cut filler for the manufacture of cigarettes.

DETAILED DESCRIPTION OF THE PREFERRED EMBODIMENTS

Figure 1:
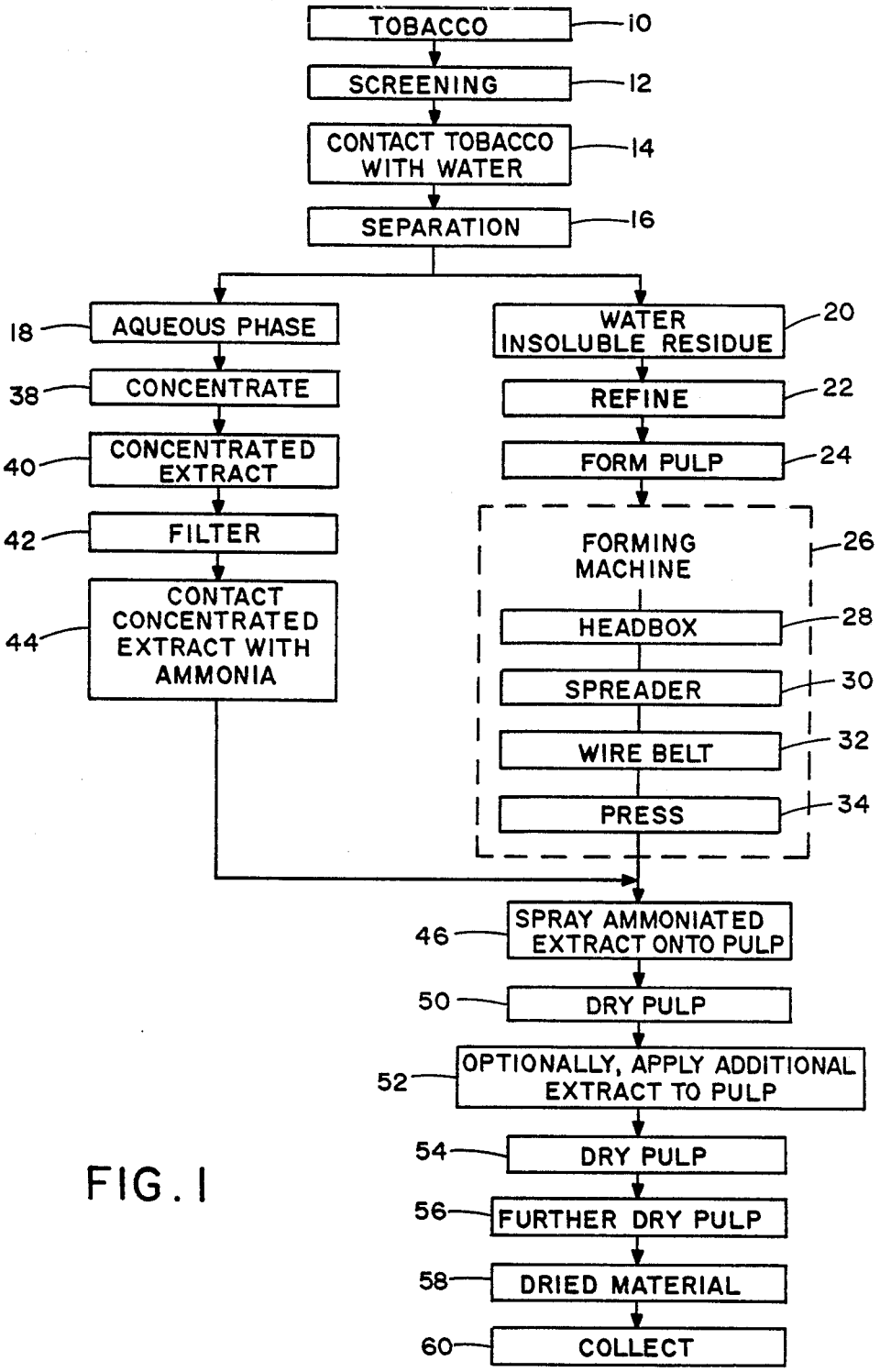
FIG. 1 is a schematic diagram of steps representative of an embodiment of this invention.

Referring to FIG. 1, tobacco material 10 can have the form of stem, dust, scrap, or the like. One or more of the aforementioned exemplary tobacco materials can be provided separately, or as blends thereof. The tobacco material can be screened 12 or otherwise processed (eg., centrifuged in the case of tobacco dust) to remove impurities such as sand therefrom. Techniques for removing particular impurities from particular tobacco materials can vary, depending upon factors such as the form of the tobacco material being processed; and such techniques will be apparent to the skilled artisan.

The tobacco material is contacted with water 14 under conditions such that water soluble components of the tobacco are extracted by the water. The mixture, which is an aqueous tobacco slurry, is subjected to separation conditions 16 so as to provide extracted tobacco components in an aqueous phase 18 and a water insoluble residue 20. The manner of separation of the liquid extract from the insoluble residue can vary. Typical separation techniques involve centrifugation, the use of one or more passes of the mixture through a screw press, or the like.

The water insoluble residue 20 can be refined 22 using paper-making type refiners such as disc refiners, conical refiners, or the like. As such, the residue is subjected to a size reduction step and thereby is formed into pulp 24 for use in the subsequent manufacture of a reconstituted tobacco product. The pulp 24 is transferred to a forming machine 26 consisting of a headbox 28, a spreader 30, a continuous wire belt 32, and a series of presses 34. Such a forming machine is common in the paper-making industry. Such a forming machine and the operation thereof will be apparent to the skilled artisan. The pulp is laid onto the wire belt 32, thereby forming a sheet-like shape, and excess water is released from the pulp using the series of presses 34.

Meanwhile, the liquid extract 18 is concentrated 38 by heating or other such method to evaporate a desired amount of the water. For example, the extract can be passed over steam-filled circulation tubes. Optionally, the concentrated extract 40 is filtered 42 using a screening technique or the like, in order to remove suspended solid materials from the liquid extract.

The liquid extract is contacted with ammonia 44. For example, anhydrous, gaseous ammonia can be introduced into a static mixer, a "scrubber," or the like, so as to contact the concentrated liquid extract at a controlled rate. The mixture of the liquid extract and ammonia then is applied to the pulp 24 on the wire belt 32 using a spraying technique 46 or a similar application means such as a roll press.

The sheet-like pulp having the liquid extract applied thereto is passed through a dryer 50 such as an apron drier, or the like. If desired, a further amount of the liquid extract 52 can be applied to one or both sides of the dried pulp 54, and the resulting material can be passed through another dryer 56. Alternatively, the resulting material can be passed through the dryer or dryers more than one time. The dried reconstituted tobacco material 58 which results can be collected 60 and is processed further as required for use as smokable filler for cigarettes.

Tobacco materials used in the process of this invention can vary. Examples of suitable tobaccos include flue-cured, Burley and Maryland tobaccos, although other types of tobacco can be employed. The tobacco material generally has been aged, and can be in the form of laminae and/or stem, or can be in a processed form. Typically, the tobacco material employed is a waste material and/or processing by-product such as fines, dust, scrap or stem. The aforementioned materials can be processed separately, or as blends thereof.

The tobacco material is contacted with a solvent having an aqueous character. Such a solvent consists primarily of water, and can be essentially pure water in certain circumstances. However, the solvent can include water having substances such as pH buffers or the like dissolved therein. The solvent also can be a co-solvent mixture of water and minor amounts of one or more solvents which are miscible therewith. An example of such a co-solvent mixture is a solvent consisting of 95 parts water and 5 parts ethanol.

The amount of tobacco material which is contacted with the first solvent can vary. Typically, the weight of solvent relative to the tobacco material is greater than 4:1, and oftentimes greater than 5:1. The amount of solvent relative to tobacco material depends upon factors such as the type of solvent, the temperature at which the extraction is performed, the type or form of tobacco which is extracted, the manner in which contact of the tobacco material and solvent is conducted, and other such factors. The manner of contacting the tobacco material and first solvent is not particularly critical.

The conditions under which the extraction is performed can vary. Typical temperatures range from about ambient to about 175° F. The solvent/tobacco material mixture can be agitated (eg., stirred, shaken, or otherwise mixed) in order to increase the rate at which extraction occurs. Typically, adequate extraction of components occurs in less than about 60 minutes, and oftentimes is less than about 30 minutes. As such, an aqueous tobacco slurry is provided.

The solvent and extracted components are separated from the insoluble residue. The manner of separation of the components of the slurry can vary; however, it is convenient to employ conventional separation means such as filtration, centrifugation, pressing, or the like. Generally, the separation of the components of the slurry is performed while the slurry is maintained at a temperature above ambient. It is desirable to provide a solution of solvent and extracted components having a very low level of suspended solids while removing the greatest amount of solvent from the insoluble residue as is possible.

Typically, the separation of the components of the aqueous tobacco slurry is performed in order to provide (i) a damp pulp; and (ii) an aqueous extract having extracted tobacco components therein.

The pulp is formed into a sheet, or other desired shape. Typically, the pulp is laid onto a wire mesh belt using known papermaking techniques and equipment. The pulp then is treated to remove excess water therefrom by passing the pulp through a series of presses, dryers, vacuum boxes, or the like. Techniques for removing excess water from formed pulp will be apparent to the skilled artisan.

The liquid extract is concentrated. Typically, the aqueous phase is evaporated such that the concentrated extract includes more than about 20 percent extracted tobacco components, based on the weight of the extracted components and solvent.

The concentrated tobacco extract is contacted with ammonia. Preferably, the ammonia is essentially anhydrous ammonia. Anhydrous ammonia is commercially available, and typically has a purity which exceeds 99 percent. Although the manner of contact can vary, it generally is convenient to inject gaseous ammonia into the region through which the extract is flowing. For example, gaseous anhydrous ammonia can be bubbled through the aqueous extract. Alternatively, a concentrated ammonium hydroxide solution can be pumped into contact with the liquid extract. Typically, the amount of ammonia contacted with the extract is about 0.1 to about 5 percent, preferably about 1.5 to about 4 percent, preferably about 2.5 to 3.5 percent, based on the total weight of the tobacco components within the liquid extract Normally, contact of the ammonia and aqueous tobacco extract occurs at a temperature of about 100° F. to about 200° F., preferably about 110° F. to about 140° F. Normally, the ammonia and aqueous tobacco extract are allowed to remain in contact for an average of about 2 to about 60 minutes prior to applying the ammoniated extract to the pulp.

Optionally, the concentrated, ammoniated, aqueous tobacco extract can be contacted with a further aqueous tobacco extract or finely divided tobacco particles. For example, tobacco dust can be centrifuged to remove sand therefrom, and a small amount of the dust can be mixed with the ammoniated extract.

The ammoniated liquid tobacco extract is applied to the pulp. For example, the extract is uniformly applied to the pulp using a series of spray nozzles, a series of sizing rollers, or other such means. However, the manner of applying the liquid extract is not particularly critical. Normally, the moisture content of the pulp just prior to the time that the ammoniated extract is applied thereto ranges from about 40 to about 80 percent, based on the weight of the pulp and moisture; and pulp having a sheet-like shape is such that the weight thereof is about 1 gram to about 6 grams per square foot. The pulp having the extract applied thereto is dried to remove moisture therefrom using tunnel-type dryers, or the like. One or more applications of ammoniated extract can be applied to the pulp. The resulting tobacco material is dried to a moisture content of about 10 to about 15 weight percent.

Reconstituted tobacco materials, which are manufactured according to the process of this invention, have reduced sugar contents relative to reconstituted tobacco materials similarly manufactured but not incorporating ammonia into the reconstitution process. Typically, the amount of ammonia contacted with the aqueous tobacco extract and the conditions under which the materials are contacted is such that the resulting reconstituted tobacco material exhibits an ammonia content of about 0.3 to about 0.5 weight percent.

What is claimed is:

1. A process for providing a reconstituted tobacco material, the process comprising the steps of:

(a) extracting components from tobacco material using a liquid solvent having an aqueous character thereby providing (i) a liquid solvent having extracted tobacco components therein, and (ii) a tobacco portion insoluble in the solvent; and then (b) separating at least a portion of the liquid solvent and extracted tobacco components therein from the insoluble tobacco portion; and then (c) forming the insoluble tobacco portion into a predetermined shape; and (d) contacting the liquid solvent and extracted tobacco components with an effective amount of ammonia so as to ammoniate the extracted tobacco components; and then (e) contacting the insoluble tobacco portion of step (c) with ammoniated liquid solvent and extracted tobacco components of step (d).

2. The process of claim 1 whereby the solvent and extracted tobacco components are contacted with anhydrous ammonia.

3. The process of claim 1 or 2 whereby the insoluble tobacco portion is formed into a sheet-like shape.

4. The process of claim 1 whereby the tobacco material provided in step (e) is dried to a moisture content of about 10 to about 15 weight percent.

5. The process of claim 1 whereby the amount of ammonia contacted with the extracted tobacco components ranges from about 0.1 to about 5 percent, based on the total weight of the extracted tobacco components within the solvent.

6. The process of claim 1 whereby the amount of ammonia contacted with the extracted tobacco components ranges from about 2.5 to about 3.5 percent, based on the total weight of the extracted tobacco components within the solvent.

7. The process of claim 1 or 2 whereby the solvent and extracted tobacco components therein includes more than about 20 percent extracted tobacco components, based on the weight of the extracted tobacco components and solvent, prior to step (d).

8. The process of claim 1 whereby the contact of the solvent and extracted tobacco components with ammonia occurs at a temperature of about 100° F. to about 200° F.

9. The process of claim 1 whereby the contact of the solvent and extracted tobacco components with ammonia occurs at a temperature of about 110° F. to about 140° F.

10. The process of claim 1 or 4 whereby the moisture content of the insoluble tobacco portion of step (c) ranges from about 40 to about 80 percent, based on the weight of the insoluble tobacco portion and moisture. wei

* * * * *